US011434619B2

(12) United States Patent
Visch

(10) Patent No.: US 11,434,619 B2
(45) Date of Patent: Sep. 6, 2022

(54) METHOD AND SYSTEM FOR FORMING STRUCTURES IN FLUID, ESPECIALLY UNDER WATER

(71) Applicant: Baggermaatschappij Boskalis B.V., Papendrecht (NL)

(72) Inventor: Guido Luuc Visch, Rotterdam (NL)

(73) Assignee: Baggermaatschappij Boskalis B.V., Papendrecht (NL)

( * ) Notice: Subject to any disclaimer, the term of this patent is extended or adjusted under 35 U.S.C. 154(b) by 15 days.

(21) Appl. No.: 16/616,114

(22) PCT Filed: May 23, 2018

(86) PCT No.: PCT/NL2018/050340
§ 371 (c)(1),
(2) Date: Nov. 22, 2019

(87) PCT Pub. No.: WO2018/217086
PCT Pub. Date: Nov. 29, 2018

(65) Prior Publication Data

US 2021/0180285 A1 Jun. 17, 2021

(30) Foreign Application Priority Data

May 23, 2017 (NL) ..... 2018969

(51) Int. Cl.
*E02D 29/09* (2006.01)

(52) U.S. Cl.
CPC ..... *E02D 29/06* (2013.01); *E02D 2200/16* (2013.01); *E02D 2250/0007* (2013.01); *E02D 2250/0023* (2013.01); *E02D 2250/0061* (2013.01); *E02D 2300/0045* (2013.01); *E02D 2300/0079* (2013.01); *E02D 2600/30* (2013.01)

(58) Field of Classification Search
CPC ..... E02D 5/64; E02D 15/06; E02D 37/00; E02D 29/06
USPC ..... 405/211, 211.1, 216
See application file for complete search history.

(56) References Cited

U.S. PATENT DOCUMENTS 3,466,879 A 9/1969 Justice
3,726,950 A * 4/1973 Turzillo ..... E04B 1/168 264/32
3,736,759 A * 6/1973 Blose ..... E02D 5/60 405/216

(Continued)

FOREIGN PATENT DOCUMENTS

JP 60148907 A * 8/1985 ..... E02B 17/0017
WO 2011/128269 A1 10/2011
WO 2018/033643 A1 2/2018

OTHER PUBLICATIONS

Tumbleston et al.,"Continuous liquid interface production of 3D objects" pp. 1349-1352, Mar. 2015.*

(Continued)

*Primary Examiner* — Frederick L Lagman
(74) *Attorney, Agent, or Firm* — Pillsbury Winthrop Shaw Pittman, LLP

(57) ABSTRACT

The disclosure is related to a method for forming structures in a liquid, preferably underwater using a flowing, settable material, wherein the material used has a density which is substantially equal to the density of the liquid in which the structure is formed as well as a system for such method and structures formed.

20 Claims, 5 Drawing Sheets

(56) References Cited

U.S. PATENT DOCUMENTS

| | | | | |
|---|---|---|---|---|
| 3,984,989 | A * | 10/1976 | Turzillo | E02D 3/08 405/222 |
| 4,393,901 | A * | 7/1983 | Beck | C04B 20/10 138/103 |
| 4,488,836 | A | 12/1984 | Cour | |
| 4,513,029 | A * | 4/1985 | Sakai | C09D 5/1656 106/15.05 |
| 4,583,882 | A | 4/1986 | Szabo | |
| 10,202,751 | B2 * | 2/2019 | Pisklak | E04B 1/16 |
| 2006/0174804 | A1 * | 8/2006 | Caveny | C09K 8/473 106/676 |
| 2008/0066652 | A1 * | 3/2008 | Fraser | C09K 8/46 106/709 |
| 2010/0061461 | A1 | 3/2010 | Bankoski et al. | |
| 2012/0257677 | A1 | 10/2012 | Bankoski et al. | |
| 2015/0175481 | A1 * | 6/2015 | Pisklak | E04B 1/16 264/31 |
| 2015/0191993 | A1 * | 7/2015 | Falcone | C09K 8/46 166/293 |

OTHER PUBLICATIONS

International Search Report dated Sep. 28, 2018 issued in corresponding International Patent Application No. PCT/NL2018/050340 (2 pgs.).

International Preliminary Report on Patentability dated Apr. 16, 2019 issued in corresponding International Patent Application No. PCT/NL2018/050340 (6 pgs.).

Susanna Minasyan et al., "An Image Compression Scheme Based on Parametric Haar-like Transform", 2005 IEEE International Symposium on Circuits and Systems (ISCAS), May 23-26, 2005, pp. 2088-2091.

* cited by examiner

METHOD AND SYSTEM FOR FORMING STRUCTURES IN FLUID, ESPECIALLY UNDER WATER

CROSS-REFERENCE TO RELATED APPLICATIONS

This application is a national stage entry of PCT/NL2018/050340, filed Nov. 29, 2018, which claims priority to: Netherlands Application No. 2018969, filed May 23, 2017, the entire contents of all of which are herein incorporated by reference in their entireties.

The invention relates to a method for forming structures in fluid, especially under water. The invention further relates to structures formed in fluid, especially under water.

Under water structures are known in the art for use in fresh or salt water, made from flowable, setting material, such as concrete or other cement based materials. The setting of the material provides for a lasting shape of the structure, whereas the flowing capacity prior to setting provides for the possibility of shaping the structure, for example in a mould.

It is known in the art to form structures or components thereof on shore in a mould, allow it to set and then transport the structures or parts thereof to a location for sue of the structure. There the structure is lowered in to a body of water and placed on the bottom of said body of water, for example a river, lake, sea or ocean. If parts of the structure are formed first, they may be assembled before and/or after lowering them into the water. The structure as formed is made to sink to the bottom and rest thereupon at least be force of gravity and of the weight of the water on top of it.

It is furthermore known to form a structure on the bottom of a body of water from a flowable, setting material, by providing a cast positioned on the bottom, connecting a filling hose to it and allowing the flowing material to flow into the cast. To this end the flowing material has to be insoluble in the water and have to drive any water from the cast while being inserted. The flowing material will pour into the cast at least by gravity, pushing the water out. After cast and setting of the structure the cast may be removed again.

U.S. Pat. No. 4,583,882 discloses a method and apparatus for under water forming of structures, in which a gelled mass is used which has a density high enough to ensure the structure to sink to and rest on the water bottom.

It is an aim of the present disclosure to provide for an alternative method for forming structures from flowable, setting material. An aim of the present disclosure is to provide for a method for forming structures in a liquid, such as for example under water. An aim of the present disclosure is to provide for a method for forming relatively light weight structures. An aim of the present disclosure is to provide for a method for forming structures from a flowable, setting material, which provides for a relatively high degree of freedom for shaping such structure. An aim of the present disclosure is to provide structures or parts thereof manufactured in a liquid such as under water.

In an aspect a method according to the disclosure comprises forming a structure in a liquid, such as under water, using a flowing, settable material, wherein the material used has a density which is substantially equal to the density of the liquid in which the structure is formed.

In embodiments the material can be injected directly into the liquid, such as water at a desired level at which the structure is to be formed. Since the density of the material is substantially the same as the density of the surrounding liquid, it will neither sink nor rise in the water to any relevant extent. In embodiments of a method of the present disclosure the material can be injected directly into the liquid at a desired level at which the structure is to be formed, free forming said structure in the liquid.

In embodiments according to the present disclosure the structure can be formed using a casing or cast. Preferably a casing used in such method is flexible and/or pliable and/or a light weight casing.

A casing for use in a method of the disclosure can for example be an inflatable.

In embodiments of the disclosure a material can be used comprising non-compressible particles. In embodiments such particles can be made using glass, wherein the particles are preferably glass spheres.

In embodiments a structure can be made according to the present disclosure, in a liquid such as under water, where after the structure stays in the liquid, especially under water for further use, at the same or a different location. If it is to be used at a different location the structure can be easily towed to such location due to the neutral buoyancy of the material. No or only very little lifting has to be provided for.

In embodiments a structure can be made according to the present disclosure, in a liquid such as under water, where after the structure is removed from the liquid at least partly, for further use, at the same or a different location, for example at least partly outside the water. If it is to be used at a different location the structure can be easily towed to such location due to the neutral buoyancy of the material, or can be lifted from the liquid and then be transported to a location of use.

The present disclosure is also directed to structures formed with a method of the present invention, as well as systems for forming structures in a liquid, such as under water, such as for performing a method of the disclosure.

Obviously some or all of the embodiments or parts thereof as disclosed can be combined within the scope of the present disclosure as defined by the claims.

In further elucidation of the present invention embodiments of the present disclosure, such as but not limited to embodiments of a structure, as well as methods and systems for forming the same shall be described hereafter, with reference to the drawings. These should by no means be considered as limiting the scope of the disclosure in any way.

Figure 1:
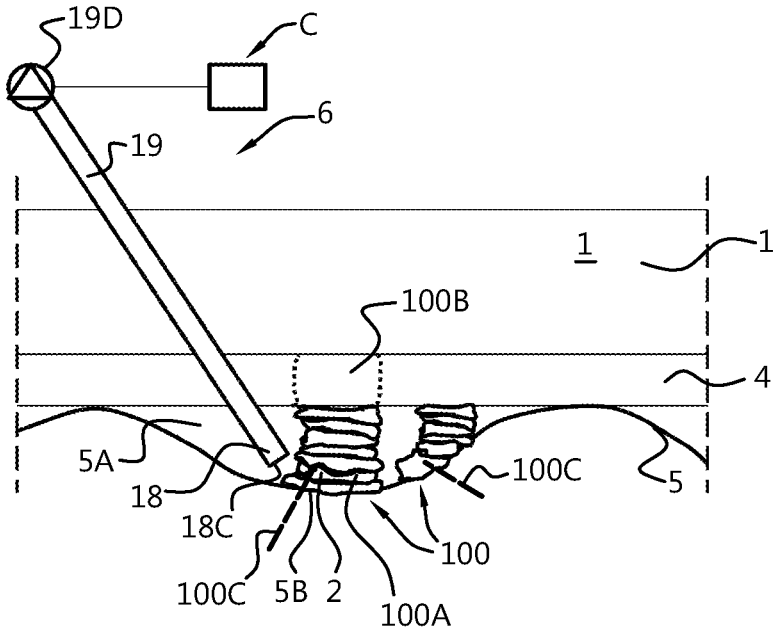
FIG. 1-4 show methods for free forming structures in a liquid such as under water, for example in a body of water at least partly below a water surface thereof.
Figure 2:
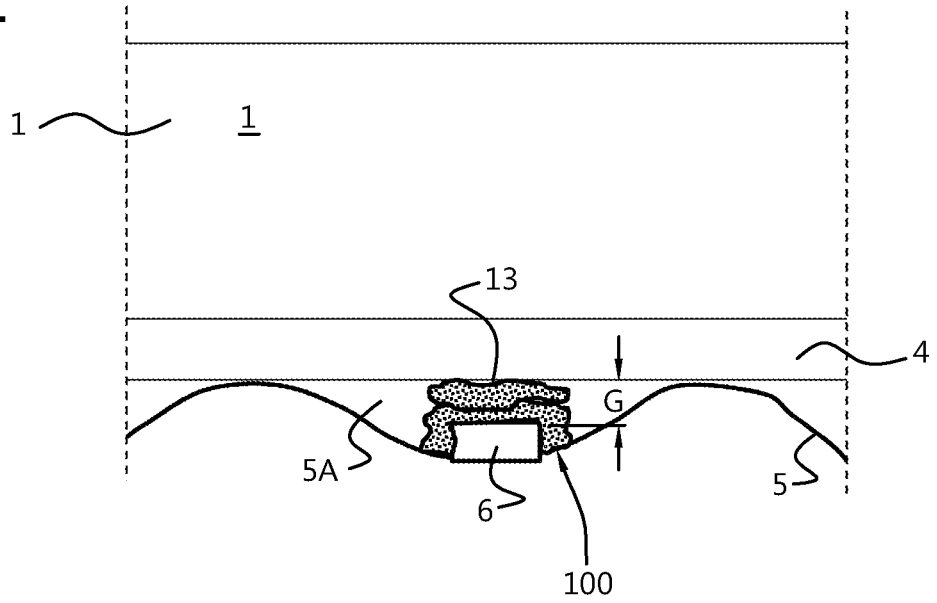
Figure 3A:
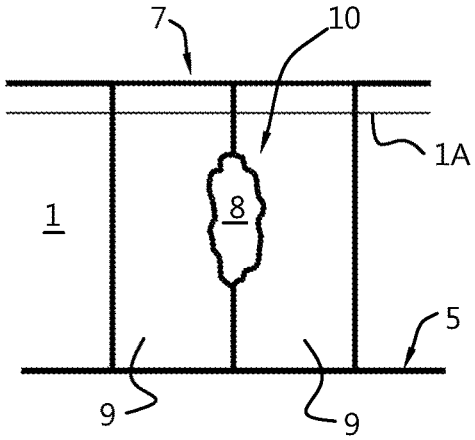
Figure 3B:
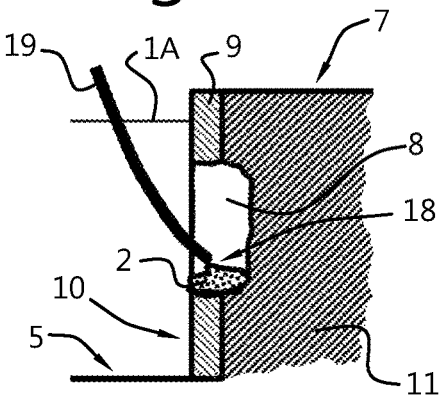
Figure 3C:
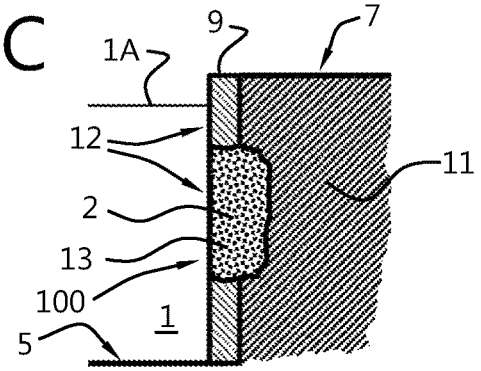
Figure 4:
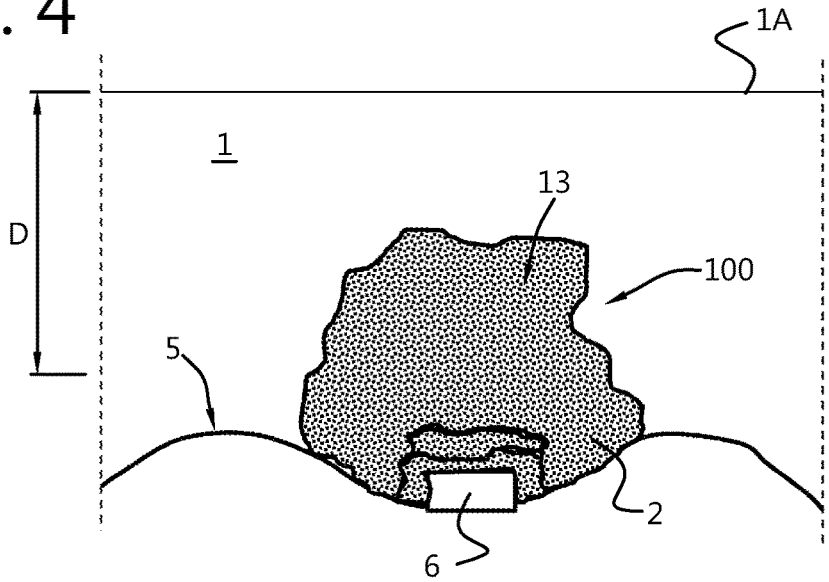
Figure 5:
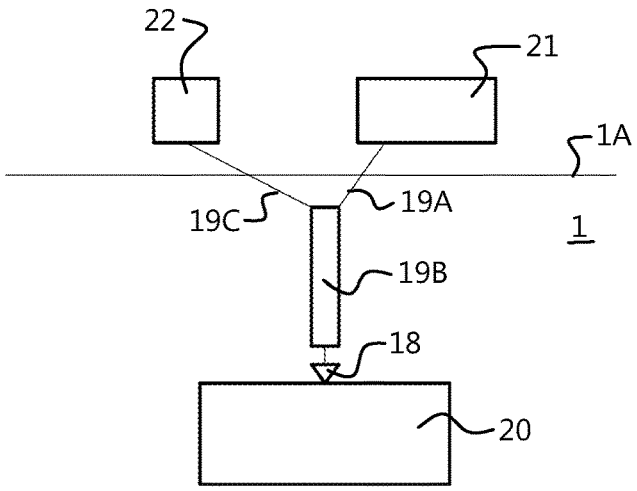
FIGS. 5, 5A and 5B show a system and parts thereof for use with a method of the present disclosure.
Figure 5A:
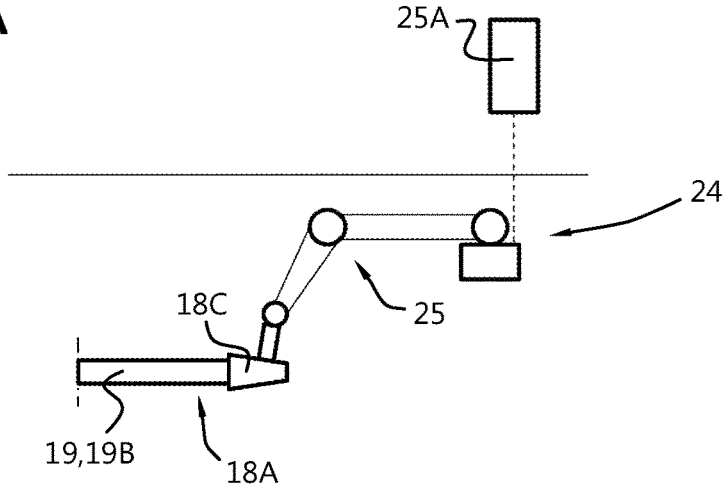
Figure 5B:
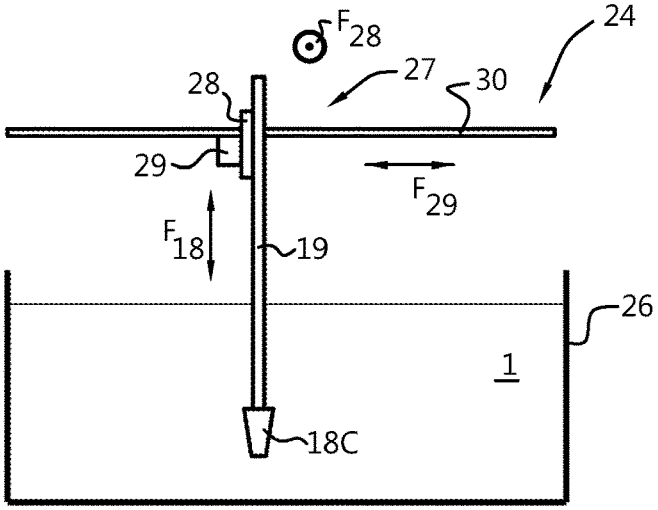
Figure 6:
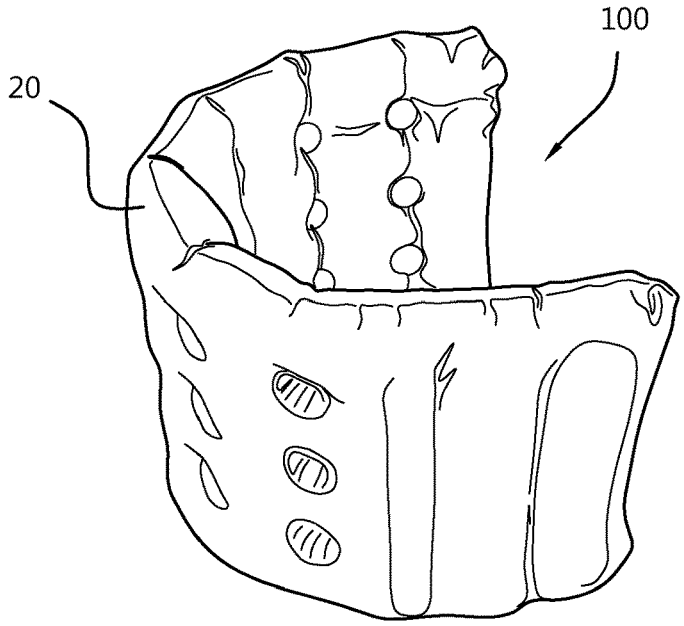
FIG. 6-10 show methods for forming structures in a liquid, for example in a body of water at least partly below a water surface thereof, using moulds such as casts or casings or artefacts for forming such structures.
Figure 7:
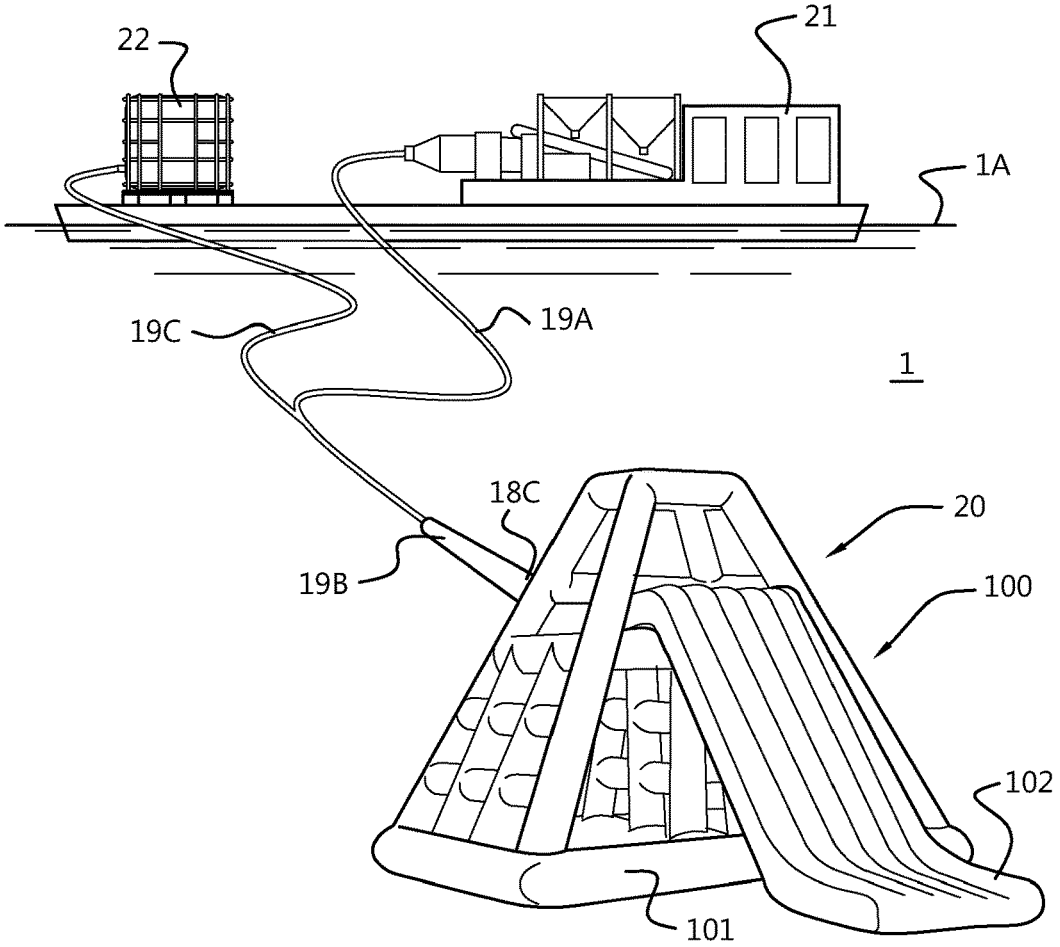
Figure 8:
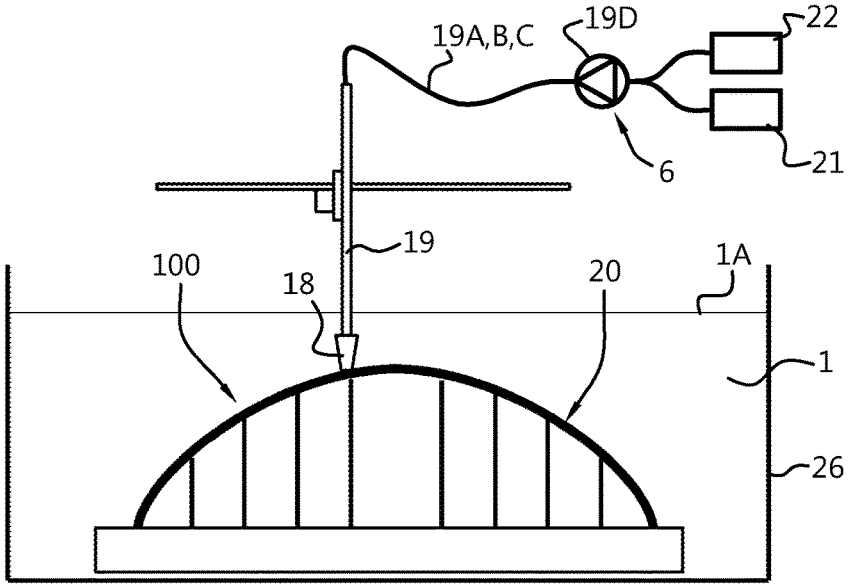
Figure 9:
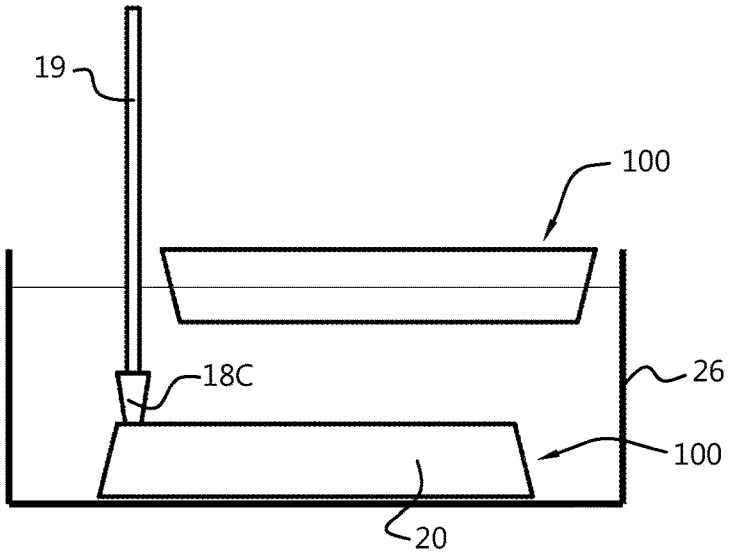
Figure 10:
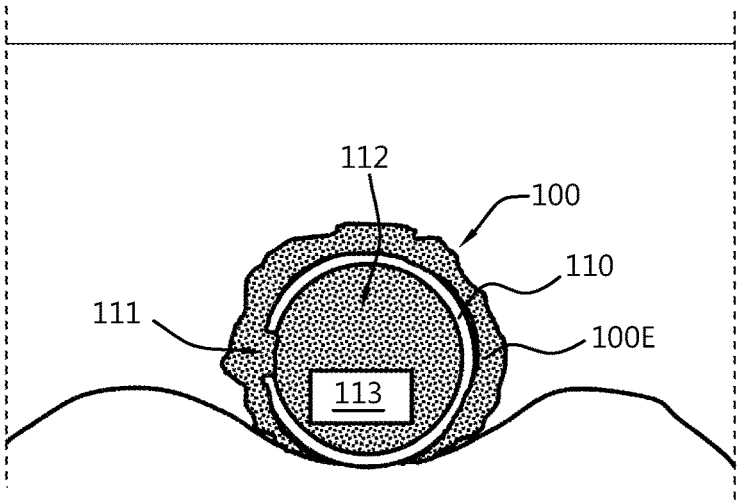

FIG. 1 schematically shows a free forming of a support structure for an artefact or assembly of artefacts, such as for example a line or pipe;

FIG. 2 schematically shows an embodiment in which the material is injected into and/or over and/or against a support structure. Such support structure can for example be a natural or artificial structure;

FIG. 3A-C schematically show steps in a method according to the disclosure used for repair of a quay or wall or such partially submerged structure;

FIG. 4 schematically shows a method of the present invention wherein a structure is free formed at a water bottom. In this embodiment the structure can for example be or can be part of an artificial reef, a pier, dike, jetty or the like;

FIG. 5 schematically shows a system for delivering a material and/or components thereof to a position in a liquid, such as for example under water for injection into the liquid directly or into a casing or cast or such mold;

FIGS. 5A and 5B schematically show parts of embodiments for delivery of material according to the disclosure;

FIG. 6 schematically shows an embodiment of a method using a mould;

FIG. 7 schematically shows a further embodiment of a method using a mould;

FIG. 8 schematically shows an embodiment of a structure formed in a liquid such as a body of water for use at least partly outside said body of liquid. In this embodiment the structure is a bridge element or part thereof;

FIG. 9 schematically shows an embodiment of a structure formed in a body of water for use on a body of water. In this embodiment the structure is a boat or at least a hull of a boat; and FIG. 10 schematically shows an embodiment of an artefact in a body of water, to be filled and/or encased by material according to the present disclosure.

In this description embodiments of the invention will be described with reference to the drawings by way of example only. These embodiments should by no means be understood as limiting the scope of the disclosure. At least all combinations of elements and features of the embodiments shown are also considered to have been disclosed herein. In this description the same or similar elements and features will be referred to by the same or similar reference signs.

In this description expressions of orientation such as top, bottom, vertical etcetera are used for convenience only and refer to the orientation as seen in the accompanying drawings. Such expressions are not to be regarded as limiting the orientation, and indeed, as will be described below, structures according to the description can be used in any orientation.

In this disclosure a flowable, setting material should be understood as a material composition which may be a mixture of different components, which may be mixed at any stage in the method, though preferably the material is fully mixed upon introducing it into a cast or mould or into a liquid, especially the water. Such material can be cement or concrete based material, or a polymer based material of combinations thereof.

In this disclosure methods, structures and objects and systems are described, as well as materials to be used therefor and/or therewith, mainly in relation to water, especially salt water. However, these can also be used in or with different liquids, including but not limited to naturally occurring liquids, oils or oil products and water containing additives, for example but not limited to additives for increasing or decreasing the density of the water. However, for most applications water is used as it naturally occurs.

In this disclosure substantially should, at least with respect to the density of the material and surrounding water, be understood as meaning that there may be a small difference between the densities of said material and said surrounding water. Within the definition of substantially the same density may fall a density of the material which is between 10% higher and 10% lower, such as for example between 5% higher and 5% lower than the density of the water, for example between 4% higher and 4% lower, such as between 3% higher and 3% lower. In embodiments the density of the material is between 0 and 10% higher, for example between 0% and 5% higher than the density of the water, more preferably between 0 and 4% higher. In embodiments the density of the material is between 0 and 10% lower, for example between 0% and 5% lower than the density of the water, more preferably between 0 and 4% lower.

When referring to density of the material this should be understood as at least including an average density of the material, wherein the highest density of the material during use is preferably not more than 10% higher than the lowest density, more preferably not more than 8%, more preferably not more than 5%.

In this disclosure neutrally buoyant material should be understood as at least meaning that the material behaves in the surrounding liquid as if it is substantially weightless. It can be understood as meaning that it will not by itself sink or rise to a surface in the surrounding liquid. It can be understood as meaning that the density of the material, such as slurry or paste used for forming an object is substantially the same as the density of the liquid, such as but not limited to water, in which said forming is performed.

Free forming should in this disclosure be understood as at least meaning forming of a structure by injecting the material into the water without a cast or into an open cast, such that at least part of the flowing material during setting is in direct contact with the water. Free forming can also include forming the structure onto and/or against and/or partly in a support structure. Such support structure can be a natural structure, for example but not limited to a water bottom, rock, riff or the like, or an artificial structure, such as but not limited to an anchoring structure or frame, a wall such as a quay, a pillar or foundation or a shell shaped support structure.

In this disclosure injecting material should be understood as including inserting the material into water and/or a cast or casing at any pressure and any flow and speed of flow or debit, such that it overcomes at least a counter pressure from the water into which the material is injected and/or water and/or air in a cast or casing into which the material is injected and/or a counter pressure exerted by the cast or casing, when used. Such injection can also include providing a reduced pressure in a cast or casing for sucking the material into such casing or cast.

In this disclosure a structure formed from or using said flowable, setting material should be understood as also including structures which are to form parts of larger structures. In this disclosure a structure formed from or using said flowable, setting material should be understood as also including structures in which parts are formed using other materials, such as frames, inserts, connectors and the like.

In this disclosure non-compressible particles should at least be understood as meaning particles which do substantially not compress by the weight of water available above the material when being injected into the water or into a casing and the weight of the material itself. Wherein substantially not compress should in this disclosure at least be understood as compression of less than 5% of the initial volume of the particles, preferably less than 3%, more preferably less than 1% and/or a reduction in size in a vertical direction of less than 5% of the initial said dimension of the particles, preferably less than 3%, more preferably less than 1%, preferably both prior to and after setting of the material.

In the drawings schematically methods are disclosed for forming structures 100 under water 1 using a flowing, settable material 2. According to the disclosure the material 2 used has a density $D_m$ which is substantially equal to the density $D_w$ of the water 1 in which the structure 100 is formed. The density $D_m$ of the material 2 is chosen and/or controlled such that it has said density $D_m$ substantially equal to the density of the water $D_w$ at the level where the material is to be injected into the water 1 or into a casing or cast 3. The material 2 can further on also be referred to as neutrally buoyant material 2. Preferably the material 2 is water resistant, which can be understood as at least meaning that when injected into the water the material will not separate or deteriorate, that substantially no parts of the material will dissolve in the water and that the material can set in the water to harden the structure.

By injecting the material 2 with a density $D_m$ substantially equal to the density $D_w$ of the water 1 surrounding the material 2 when injecting has the advantage that the material will have neutral buoyancy at said level and will therefore substantially neither sink nor float upward. It will stay substantially at the position where it is injected or be pushed into and/or through a cast or casing when using such. Moreover, it will substantially retain the shape it is brought into during setting, without the necessity of solid, closed casings which can withstand the pressure of the water and/or the material.

Hence with a method according to the present disclosure the material can be injected directly into the water, free forming structures as is schematically shown in FIG. 1-4. Free forming should be understood at least as forming a structure under water without using a casing or cast into which the material is injected for defining its outer shape and dimensions.

FIG. 1 shows a free forming of a support structure 100 for a line 4 which extends over a bottom 5 of a body of water 1, such as for example a lake, sea or ocean. A line 4 can for example be a pipeline for oil or gas, or a electrical line, such as a telecommunication line, an umbilical or any such under water line structure. As can be seen in FIG. 1 the bottom 5 can comprise areas which are not sufficiently flat to support such line 4 properly. For example a line 4 can be preferred to extend substantially straight over a valley or trench 5A in said bottom 5. With a method according to the disclosure a neutral buoyant, settable material 2 is fed to the location of the valley or trench 5A, for example through one or more feeding lines 6, for example as will be discussed further on. At the location the material 2 is injected into the water 1, first against a bottom portion 5B of the valley 5A, forming a base 100A, after which gradually more material 2 is injected onto said based 100A, building up a supporting structure 100 between the said bottom 5B of the valley 5A and the line 4. Due to the specifically chosen density $D_m$ of the material 2, chosen in view of the density $D_w$ of the water 1 at said location, the material 2 and hence the structure 100 formed will stay substantially where it is injected. Obviously, as discussed, the material 2 has to be chosen such that it does not water soluble or at least that the material maintains its composition as far as necessary for setting in the liquid in which it is used. The material or material composition chosen for use in the present disclosure, at least in flowable condition and preferably also during setting, preferably has an internal cohesion between components of the material such that it can withstand interference with the shape of an object formed during setting due to for example imbalance, currents, waves or differences in density of the material and/or the surrounding liquid.

As can be seen in FIG. 1 one or more of such support structures 100 can be formed below said line 4, at desired location or locations. In embodiments a structure 100 can be formed such that the base 100A thereof is connected to the bottom 5, for example by forcing part of the material into the bottom and/or rocks or the like natural elements and/or artefacts in and/or on said bottom 5, and/or the structure 100 can be formed such that it is connected to the line, for example by forming the structure partly or entirely surrounding a part of the line 4, as schematically shown by dotted lines 100B and/or by providing the bottom 5 and/or line 4 with anchoring provisions, schematically shown by dotted lines 100C, which can be surrounded at least partly by the flowable material prior to and/or during setting, such that the structure is anchored to the bottom 5 and/or line 4.

For forming structures in a liquid, such as under water, a system can be used, comprising at least one source C of flowable, settable material or components for forming such material, and feeding line or lines 6, such as for example at least one hose 19 for under water delivery of said material or components thereof. At least one pump 19D can be provided for pumping said material 2 or components through the relevant hose or hoses 19, such that the material 2 or mixture of components can be injected into the water 1 through a nozzle 18C connected to said hose or hoses 19. At least one component can be provided for regulating the density $D_m$ of the material 2 or mixture of components, such that the density $D_m$ can be adjusted to correspond substantially with the density $D_w$ of the water 1 in which it is to be injected, at the level at which it is to be injected. It shall be clear that materials 2 for use can be provided as a premix, for example in matches. Alternatively a mixture of components can be provided as a premix. Additionally or alternatively components for the material 2 can be mixed in situ.

For delivery of the material 2 at a desired position the delivery line or lines, especially an outlet thereof, can be manipulated in any desired manner. Especially when free forming is used, the delivery end of a delivery hose 19, such as a nozzle 18C can be manipulated, for example by a diver, an ROV, a manipulator arm or arms, for example mounted on an ROV or a surface operated vessel, or can be self propelled and remote controlled.

As schematically shown in FIG. 2 in embodiments the material can be injected into and/or over and/or against a support structure. Such support structure can for example be a natural or artificial structure.

In embodiments a support structure can for example be a relatively heavy element 6, such as for example a concrete or basalt block, frame or the like can be placed on said bottom 5A, below the line 4, where after the material 2 may be injected into and/or onto and/or against the said element 6, filling at least a gap G between the line 4 and the element 6 and/or forming a support structure 100 for said line 4. Such element 6 can be advantageous in that it can prevent the structure 100 from being subject to currents which could otherwise possible displace the structure 100. Such element 6 can additionally or alternatively provide further support and/or can make a method of forming a structure quicker and/or easier and/or less expensive since less material 2 is needed and less such material 2 has to set after injection. Similarly a method according to the disclosure can be used for repair of structures, for example for supporting a line 4, which structures and/or line may have deteriorated or changed position over time, losing a proper support function for the line. By injecting material 2 with a method of the disclosure, such supporting function can at least partly be reestablished.

In FIGS. 1 and 2 the structure 100 is used supporting a line 4. It shall however be clear that in the same or similar way any other element or structure can be supported by such structure, such as for example but not limited to a platform, housing, connector station, equipment or the like, wherein a structure 100 can be used for both temporary and permanent support.

In FIG. 3A-C a method according to the disclosure is used for repair of a quay or wall 7 or such.

In FIG. 3A a quay 7 is shown, in frontal view, having a hole 8 between two concrete plates 9 forming an outer wall 10 of the quay 7. Water 1 can seep through the hole 8 and damage the body 11 behind the plates 9 thus deteriorating the structural integrity of the quay 7.

In FIG. 3B it is shown, from a cross sectional side view, that an amount of material 2 is injected into the hole, at least below the waterline 1A, filling the hole 8 between the plates 9 and, if present, behind the plates 9. Dependent on for example the injection pressure and the structure of the body 11, the material 2 may partly enter into the body 11 too.

In FIG. 3C the quay 7 is shown after the material 2 has set. During setting the material 2 may be handled further, for example using plastering type tools flattening an outer surface 12 of the material 2, for example in order to bring it in line with the surfaces of the plates 9. The material 2 after setting closes off the hole and hence prevents the body 11 from deterioration.

It shall be clear that in a similar manner other surfaces and openings in other structures at least below a water line or water surface can be treated with material 2 according to the invention. Again it shall be noted that due to the specifically chosen density of the material 2 prior to and during setting the material will substantially stay where it has been injected, without floating up or down in the water.

In FIG. 4 schematically a method of the present invention is disclosed, wherein a structure 100 is free formed at a water bottom 5. In this embodiment the structure 100 can for example be or can be part of an artificial reef, a pier, dike, jetty or the like.

A material 2 used in the present disclosure can be a cement or concrete based material. The material 2 can be neutrally buoyant, which should be understood as at least meaning that the material 2 when injected into a body of water at a predetermined depth below the water surface of said body of water will substantially hover in said body of water, i.e. will be suspended without substantial movement up or down in said water due to gravity and water pressure. As discussed, the material 2 can be designed to have a density $D_m$ substantially equal to the density $D_w$ of the water 1 at said depth. In this disclosure water or body of water should be understood as at least meaning, but is not limited to, a body of salt or fresh water. In embodiments additives can be added to the water 1 in order to for example increase or decrease the density, especially if a body of water is used in a relatively confined space, such as a basin, dock or the like, with a body of water confined to said space. Such additives will be known in the art and can for example be, but are not limited to salt, fluids having a density other than water or the like.

A material 2 or a basis material for mixing a material 2 can for example comprise cement, a pozzolanic filler, water, micro fibers and a set accelerating admixture or additive. Such components are well known in the art. Micro fibers can for example be made of plastics, such as but not limited to PE or PVA, and can for example have a length of several mm and a thickness of several μm. By way of example only fibers can be used having a length of between 2 and 8 mm, for example about 4 mm, and a thickness between 10 and 40 μm, for example about 20 μm. A pozzolanic filler can for example be but not limited to metakoloin or microsillica. The water is preferably potable water. The cement can for example be Heidelberg cement. The material can be mixed, for example by in-line mixing in a transport line system between different supplies 17 and an outlet end 18 of a supply line 19. Alternatively or additionally part or all of the material can be mixed prior to providing it to a supply line 19. The material 2 is preferably mixed into a flowable constitution, such that it can be transported through the supply line 19 and dispensed through the outlet end thereof. The material may be relatively dry or can for example be a slurry when fed into the supply line 19 and is preferably a slurry when dispensed out of the outlet end 18 and injected into the water 1 or into a casing or cast or such mould 20. Especially if the material is to be injected into the water 1 the material is mixed such that it does not dissolve in said water 1. The material preferably has a consistency such that it adheres to itself when being expelled from the outlet end 18 and hence does not disintegrate when expelled from the outlet end 18. It shall be clear that a material 2 suitable for use can also be based on or comprise polymers, such as for example polyester based materials.

In embodiments the material can have a density below about 2400 kg/m$^3$, such as for example below 2000 kg/m$^3$. A material 2 can, in flowable condition, prior to setting, for example have a density between 1026 kg/m$^3$+/−10%, for example 1026 kg/m$^3$+/−5%. The density can for example be between 970 and 1080 kg/m$^3$ for use in salt water such as sea water, for example for use in water at depths up to about 1000 m. These densities are obviously only disclosed by way of example and should not be considered as limiting the scope of the disclosure. In a method the density of the liquid, such as water at the location where the structure is or is to be formed can be determined, for example by measurement, and the density of the material to be used for forming the structure can then be adjusted based on said determined density. Alternatively the density can be chosen based on a known density of the liquid in which the structure or object is to be formed. Obviously when forming a structure in a relatively confined space or body of liquid the density of the liquid could be chosen based on or adapted to a density of the material used for forming the structure or a part thereof. This should also be understood as falling within forming structures in a liquid, preferably underwater using a flowing, settable material, wherein the material used has a density which is substantially equal to the density of the liquid in which the structure is formed.

In embodiments the material 2 can comprise non compressive particles 13, especially particles 13 which are substantially non reactive with other components of the material 2, such that these particles 13 substantially maintain their shape, dimensions and consistence prior to during and after setting. The particles preferably have a density which is relatively low compared to most of the further components of the material and/or to the density of the liquid, especially water in which the material 2 is to be used, at least in flowable condition, such that the particles lower the density of the material 2. The particles 13 are preferably substantially non compressible at least at pressures occurring at the depth in the water at which the material is injected into the water or into a cast or casing as will be discussed. Preferably they are non compressible at even higher pressures. This provides for a material and a structure formed therewith which during and after setting will remain its shape more easily, whereas the load bearing capacity can be increased. Especially of the further components of the material are also substantially non-compressible, which is common for at least most cement or concrete based materials without weight reducing fillers.

The particles may be solid particles or can be partly or entirely hollow particles. Preferably such particles 13 are used having regular shapes, weights and dimensions, preferably such that all particles 13 are substantially identical to each other. Such particles can for example have, but are not limited to having, a crush strength above 2000 PSI or 13.8 Mpa, for example up to 8000 PSI or 55.2 MPa. Such particles 13 can for example have a density between for example but not limited to 0.3 and 0.7 g/cc (300-700 kg/m$^3$). In embodiments a material 2 according to the disclosure can comprise glass based particles, such as glass beads. Glass particles, especially glass beads are known in the art and can be hollow glass beads. Such particles can for example be hollow glass microspheres. Particles 13 can alternatively or additionally be or comprise expanded particles, such as for example expanded glass or clay, for example foamed particles 13.

By way of example only, sea water at 0° C. and 35 psu (salinity) can for example have a density at a water surface level of about 1.028 g/cm$^3$, at a depth D of 4000 m a density of about 1.046 g/cm$^3$ and at a depth of 10.000 m a density of about 1.071 g/cm$^3$. See table 1.

Values associated with the change in seawater density with depth are listed in the table 1.

Density changes with depth (seawater 35 parts per thousand and 0° C.)

| depth (m) | pressure (decibars) | density (g/cm$^3$) |
|---|---|---|
| 0 | 0 | 1.02813 |
| 1,000 | 1,000 | 1.03285 |
| 2,000 | 2,000 | 1.03747 |
| 4,000 | 4,000 | 1.04640 |
| 6,000 | 6,000 | 1.05495 |
| 8,000 | 8,000 | 1.06315 |
| 10,000 | 10,000 | 1.07104 |

Source: https://www.britannica.com/science/seawater/Density-of-seawater-and-pressure A concrete mixture slurry to be used as a basis for a material 2 as described can for example have a density of 1.442 g/cm$^3$ at atmospheric level. Preferably a material is used which is substantially non-compressible (1 g/cm$^3$=1000 kg/m$^3$). By using particles having a substantially lower density than the concrete slurry the average density of the material 2 can be reduced to a desired level. For example, for use at a depth in sea water of 1000 m according to table 1, the average density of the material 2 has to be reduced to about 1.033 g/m$^3$ (1033 kg/m$^3$). Starting from a cement based basis material having a density of about 1442 kg/m$^3$ and particles 13 having a density of 500 kg/m$^3$ this would mean that about 1 part particles should be added to each about 1.3 parts of cement based basis material. It is noted that this is only described by way of example and should in no way be considered as limiting the disclosure. As can be seen from for example table 1 here before the density of water does not vary very much with the depth of the body of liquid such as water. This means that for structures and object shaving a limited height, for example a height in the order of meters to tens of meters or even some hundreds of meters, the density difference over the height can in most cases be neglected or the density can be taken for example based on an average over said height or at an injection level.

The material used can be a mixture of components, wherein a number of the components is mixed and fed to a first position near a second position at which the structure is to be formed, and is mixed with at least one further component at or near said first position, such that the thus formed mixture is or can be used for forming the structure.

The density of the material 2 is preferably defined in flowable condition.

FIG. 5 schematically shows a system for delivering a material and/or components thereof to a position under water 1 for injection into the water directly or into a casing or cast or such mould 20. FIG. 5 shows a cement mixing installation 21 as for example known in the art, for supplying a cement based mixture through a first line 19A to an in line mixing line 19B. Furthermore one or more supplies 22 for further additions to the mixture through a second and/or further supply line(s) 19C is/are provided, such as for example a supply for filler, water, density regulating aggregate 13, and/or set accelerating admixture and the like. The in line mixing line 19B can comprise an outlet 18 or can be connected to a further supply line (not shown) between said in line mixing line 19B and said outlet 18. The outlet 18 can for example be comprised by a nozzle 18C for injecting the material 2 into the water 1 or a connector for connecting to an inlet opening of a casing or cast or such mould 20. The supplies such as mixing installation 21 and further supply or supplies or at least part thereof can be placed on shore, on a vessel or pontoon or platform above a water surface or can be submerged at least in part.

In FIG. 5A schematically an outlet end 18A of a supply line 19/19B, comprising an outlet formed by a nozzle 18C, is held by a system 24 for moving the nozzle 18C in desired directions and with a desired speed. Preferably the system 24 is designed for automatic and/or distant controlled operation of the movement of the nozzle 18C and the dispensing of the material 2 through the nozzle 18C. For example the nozzle 18C can be handles by a robotic arm or assembly 25, as schematically shown in FIG. 5A, for moving the nozzle 18C in different directions, especially having at least three, more preferably at least 4, for example 5 or 6 or more degrees of freedom, in order to move the nozzle 18C freely within an envelope defined by the reach of said system 24. The said movement can for example be controlled from outside the body of water 1 in which the system 24 is provided, for example controlled through a control line or wireless controlled, for example through a computer 25A. The system 24 can be designed as or similar to a 3D printer system, for printing with said material 2.

In FIG. 5B a system 24 comparable to that of FIG. 5A is shown, in which the body of water 1 is confined to a limited space, in this example a basin 26. In this embodiment above the basin a construction 27 is provided carrying a supply line 19 with a nozzle 18C at a lower end thereof. The supply line 19 is connected to a runner 28 mounted on a first rail or set of parallel rails 29 which is/are mounted movable on a second rail or set of parallel rails 30. The first and second rail(s) preferably extend in a substantially horizontal plane above the basin 26. At least the part of the supply line 19 extending downward from the runner 28 is preferably stiff or held by a stiff arm (not shown) and extends into the body of water 1 in the basin 26. This can be moved up and down relative to the runner 28 in order to bring the nozzle closer to or further away from a bottom 26A of the basin 26.

The runner 28 can move in a first direction $F_{28}$, in FIG. 5B perpendicular to the plane of the drawing, along the first rail(s) 29, whereas the first rail(s) 29 can move in a second direction $F_{29}$, perpendicular to the first direction, along the second rail(s) 30. Hence the runner 28 can be moved to any position above the basin 26 within the range of the first and second rails 29, 30 and the runner 28, whereas the nozzle can be moved up and down in a third direction $F_{18}$ through the body of water 1. Preferably the lay-out is chosen such that the nozzle 18C can be moved within the basin 26 to substantially each position. Such arrangement can then again be used substantially as a 3D printer for printing with the said material 2.

After printing or otherwise forming a structure 100 the structure 100 can be removed from the location of forming to a different location, for example by towing, lifting, driving or any other suitable manner.

FIGS. 6-10 schematically disclose embodiments of a method and structure according to the disclosure in which a cast or casing or such mould 20 is used into which a material 2 is injected. The mould 20 can be a rigid mould 20 but is preferably an at least partly flexible mould 20, such as a mould made at least partly from a flexible material, such as but not limited to plastic sheet, foil or the like enclosing at least one cavity which can be filled with the material 2 for the material to set within said mould 20. In embodiments the mould 20, or at least part thereof, can be formed by an inflatable, which can have an internal volume or internal volumes which can be increased by introducing the material 2 into the or each internal volume. Since the material 2 has substantially a neutral buoyancy at the level in the water at which it is injected into the mould the mould will not collapse due to the weight of the material, as it would if the material were heavier than the surrounding water, or float upward, as it would if the material were lighter than said water. The more so if the material 2 is non-compressible.

In FIG. 6 a sample casing or mould 20 is shown, formed by an inflatable mattress which has been filled with the material 2 under water 1, i.e. submerged in the water 1 at a level entirely below the water surface 1A. The mould 20 has a semi cylindrical shape into which it may have been bent after filling or which it can at least partly have had prior to filling. After setting of the material 2 inside the mould 20 the shape will be retained. The mould 20 can maintain in position after setting of the material or can be removed, partly or entirely.

In FIG. 7 a mould 20 is used having a more complex shape and dimensions. The mould 20 is an inflatable forming a climbing rack 101 with a slide 102 extending from it. In this embodiment the mould 20 can be submerged into a body of water 1 empty and deflated. Then a nozzle or outlet opening 18 of a supply hose 19 can be connected to at least one inlet opening (not show) of the inflatable, after which the mould 20 is filled with the material 20 having a density $D_m$ substantially equal to the density $D_w$ of the water 1, inflating or at least filling the mould 20. The structure 100 is formed within the mould 20 by allowing the material 2 to set.

After setting of the material the mould can be removed, if desired, or can stay on the structure partly or entirely. The structure can stay under water 1, for example to be used under water as an artificial reef, breaker, jetty, anchoring structure or the like, or can be lifted out of the water 1 to be used outside the water, for example as a play structure 100 on land. Since the material 2 used has a relatively low density, the structure can be relatively light compared to a similar structure made used traditional methods and materials. The structure 100 can have a relatively complex configuration, using a mould 20 which is relatively easy to manufacture and need not be rigid, as would a mould for forming such structure outside the water 1.

FIG. 8 shows schematically a bridge element as a structure 100 formed in a body of water 1 using a mould 20. The mould 20 is placed in a basin 26 and filled with the flowable material 2, which is allowed to set in said basin 26. The bridge element 100 can then be lifted out of the basin 26 and transported to a location for use as or in a bridge, especially also but not limited to outside any body of water, for example on shore. Since the material 2 used has a relatively low density, the structure can be relatively light compared to a similar structure made used traditional methods and materials. The structure 100 can have a relatively complex configuration, using a mould 20 which is relatively easy to manufacture and need not be rigid, as would a mould for forming such structure outside the water 1. In embodiments supporting structures such as for example preformed beams, tension rods reinforcing mats and/or fibers or the like can be provided in or on the mould to be included in the structure under water, for further strengthening of the structure 100 or for example for attaching, interconnecting such structures with each other and/or with other structures or other such purposes. Moreover, additionally or alternatively for example tendons or rods can be provided, especially in inflatable structures or casings used for forming, increasing a shape retaining property of the casing.

FIG. 9 shows a boat as a structure 100 formed in a liquid, such as in a body of water, in a mould 20. The mould 20 can have a partly or entirely rigid shape, but preferably is at least partly and more preferably substantially entirely flexible. The mould can have a shape reproducing the hull of the boat and may be a closed mould or can be a partly open mould 20. The mould 20 can be filled with the material 2 having substantially neutral buoyancy at the relevant water depth. Alternatively the mould 20 can have a shape different from the hull of the boat and can be brought into the desired shape after filling, for example by pressing the mould 20 into a desired shape.

After removal of the mould 20 the hull of the boat can be brought to the water surface 1A to float, as schematically shown at the upper right hand corner of FIG. 9, and can then be transported, for example by towing, to a desired location for further manufacturing of the boat. If appropriate obviously the mould could remain as a part of the boat or could be removed at a different stage, in full or in part.

FIG. 10 shows schematically an artefact 110 in a body of water, in this embodiment having at least one opening 111 and/or cavity 112 accessible from outside the artefact. In FIG. 10 this is shown as a mine 110 to be removed from the water, comprising possible explosives 113 inside the mine 110. The mine 110 has a partly hollow interior which is filled with a material 2 according to the disclosure, through the opening 111. This fills all voids 112 inside the mine 110 substantially without increasing pressure. A layer 100E of material 2 may be provided additionally or alternatively over part or all of the outer side of the mine 110, encasing the mine in a structure 100 made of the material 2. Then the mine can safely be handled, for example for transport to a different location for destroying the mine in a safe manner. In embodiments artefacts can be encased partly or entirely by the material 2, using a method according to the disclosure, even if there is no cavity in said artefact or no opening for accessing such cavity.

It shall be clear that any structure 100 formed in a body of water according to the present disclosure can be easily lifted in the water, unless anchored, and can be suspended in the body of water substantially without further provisions, such that it can be moved easily, at or below the water surface 1A.

In the present disclosure casings can be used which have a predetermined final shape when filled, such as inflatable casings as described. They may be filled such that they are tensioned at least to some extent for improving shape retention, especially during setting of the material 2. Additionally or alternatively flexible casings can be used which are less or not shape retaining and/or which do not have a predetermined final shape when filled, but are mouldable after filling in order to be shaped. For example a sack can be filled with the flowable material 2, in the body of liquid such as water, after which during setting the shape of the sack can be moulded, for example by hand or mechanically, in which shape the material can then set. For example the flexible casing can be filled close to the surface of the body of liquid or in a position of use. Such flexible casing can for example, but is not limited to, be used in a situation of FIG. 1 in which the casing can for example be pushed under a line filled with material, and then be shaped in a desired shape, or can be filled with the material after positioning the casing below the line. Such flexible casing can also be provided with devices such as straps, rods, wires, ropes or the like for aiding shaping and shape retaining when in a desired position.

The invention is by no means limited to the embodiments specifically disclosed and discussed here above. Many variations thereof are possible, including but not limited to combinations of parts of embodiments shown and described. For example a mould according to the disclosure can be provided with multiple entry openings for introducing the material and/or with one or more one way valves to expel air and/or water from the mould during filling. A method according to the disclosure can be used for forming any structure in a body of water, for later use of the structure entirely or partly in the same or a different body of water of outside any body of water. A method and material of the disclosure can be used for temporary purposes such as temporary repair of structures.

These and many other amendments are considered to have been disclosed herein also, including but not limited to all combinations of elements of the invention as disclosed, within the scope of the invention as presented.

The invention claimed is:

1. A method for forming structures in a liquid using a flowing, settable material, characterized in that the settable material has a density which is substantially equal to a density of the liquid in which each structure is formed, such that the settable material, and thus the formed structures, neither sinks nor rises relatively in the liquid during the forming, and wherein the method further comprises injecting the settable material directly into the liquid at a desired level at which each structure is formed, wherein each structure is free formed.

2. The method according to claim 1, wherein the settable material is injected into and/or over and/or against a support structure provided in the liquid, wherein the support structure is a natural structure or an artificial structure.

3. The method according to claim 1, wherein the method further comprises pumping the settable material through at least one injector line to form each said structure.

4. The method according to claim 1, wherein the settable material used is a mixture of components, and wherein the method further comprises mixing a number of the components and feeding the mixture to a position near a position at which each structure is formed, and mixing the fed mixture with at least one further component at or near said position, such that the thus formed mixture is used for forming the structure.

5. The method according to claim 1, wherein the settable material is non soluble in the liquid.

6. The method according to claim 1, wherein each structure formed is anchored to and/or by a bottom or another structure present in the liquid.

7. The method according to claim 1, wherein the structure is formed and allowed to set, and, where after the structure is set, the method further comprises moving the structure to a location for use of the structure.

8. The method according to claim 7, further comprising towing the structure to said location in a floating or submerged position.

9. The method according to claim 7, further comprising removing the structure from the liquid after the forming and setting.

10. A method for forming structures in a liquid using a flowing, settable material, characterized in that the settable material has a density which is substantially equal to a density of the liquid in which each structure is formed, such that the settable material, and thus the formed structures, neither sinks nor rises relatively in the liquid during the forming, and further comprising determining the density of the liquid at a location where each structure is formed, and adjusting the density of the material used for forming the structure based on said determined density of the liquid.

11. A structure formed in a liquid according to the method of claim 1.

12. A method for forming structures in a liquid using a flowing, settable material, characterized in that the settable material has a density which is substantially equal to a density of the liquid in which each structure is formed, such that the settable material, and thus the formed structures, neither sinks nor rises relatively in the liquid during the forming, and wherein the method further comprises injecting the settable material into a flexible casing provided in the liquid.

13. The method according to claim 12, wherein the casing comprises at least one chamber into which the settable material is injected through at least one inlet opening, wherein the casing is at least in part pliable, and wherein the casing is at least partly shaped during and/or after injection of the settable material.

14. A method for forming structures in a liquid using a flowing, settable material, characterized in that the settable material has a density which is substantially equal to a density of the liquid in which each structure is formed, such that the settable material, and thus the formed structures, neither sinks nor rises relatively in the liquid during the forming, and wherein the settable material comprises non-compressible particles.

15. The method according to claim 14, wherein the said non-compressible particles are made of glass, and wherein the particles are spheres.

16. The method according to claim 1, wherein each structure is formed using 3D printing of the settable material.

17. A system for forming structures in a liquid, the system comprising:

at least one source of (a) flowable, settable material or (b) mixture of components for forming such flowable, settable material, at least one hose for delivery of said material or mixture of components thereof, and at least one pump for pumping said material or mixture of components through the at least one hose, such that the material or the mixture of components are configured to be injected into the liquid through a nozzle connected to said at least one hose, characterized in that at least one component is provided for regulating a density of the material or the mixture of components, such that the density of the material is configured to be adjusted to correspond substantially with a density of the liquid in which it is configured to be injected, at the level at which it is injected.

18. The system according to claim 17, wherein further a casing is provided, the casing being connected to or connectable to the nozzle, and wherein the casing is at least partly flexible and/or shape retaining and closed such that the material or mixture of components injected into the casing cannot exit the casing.

19. The system according to claim 17, wherein the material or the mixture of components comprise at least cement, a pozzolanic filler, water, and a density regulating aggregate filler.

20. A method of providing a structure, using a system according to claim 17 for forming the structure in the liquid, wherein after the structure is formed, the method comprises removing the structure at least partly from the liquid for use of the structure at least partly outside said liquid in which it is formed.

* * * * *